US006547127B2

(12) United States Patent
Bradford et al.

(10) Patent No.: US 6,547,127 B2
(45) Date of Patent: Apr. 15, 2003

(54) TOTE BOX WITH MULTIPLE PIECE TOP RAIL INCLUDING CORNER PIECES WITH PROJECTIONS

(75) Inventors: Judson A. Bradford, Holland, MI (US); Timothy A. Bublitz, Holland, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 10/022,709

(22) Filed: Dec. 13, 2001

(65) Prior Publication Data

US 2002/0079359 A1 Jun. 27, 2002

Related U.S. Application Data

(63) Continuation-in-part of application No. 09/710,872, filed on Nov. 13, 2000, now Pat. No. 6,349,877.

(60) Provisional application No. 60/231,110, filed on Sep. 8, 2000.

(51) Int. Cl.[7] ..... B65D 5/44

(52) U.S. Cl. ..... 229/199; 220/4.28; 220/642; 229/198.1; 229/918; 229/919; 493/89; 493/114; 493/136

(58) Field of Search ..... 229/198.1, 199, 229/915, 918, 919; 220/4.28, 4.33, 641, 642, 646, 651, 652; 206/509, 512; 493/89, 90, 114, 115, 136

(56) References Cited

U.S. PATENT DOCUMENTS

| | | | |
|---|---|---|---|
| 249,561 | A | 11/1881 | Weston |
| 544,525 | A | 8/1895 | Bartlett |
| 825,523 | A | 7/1906 | Dewey |
| 959,734 | A | 5/1910 | Hall |
| 1,046,018 | A | 12/1912 | Reber |
| 2,304,853 | A | 12/1942 | Shaw |
| 2,496,965 | A | 2/1950 | Swingle |
| 3,220,633 | A | 11/1965 | Swane |
| 3,223,309 | A | 12/1965 | Chiorri |
| 3,226,008 | A | 12/1965 | Chiorri |
| 3,989,397 | A | 11/1976 | Baker |
| 4,172,623 | A | 10/1979 | Anderson |
| 4,210,274 | A | 7/1980 | Leonard |
| 4,619,365 | A | 10/1986 | Kelly et al. |
| 4,712,942 | A | 12/1987 | Brown |
| 4,720,013 | A | 1/1988 | Nichols et al. |
| 4,971,201 | A | 11/1990 | Sathre |
| 5,033,669 | A | 7/1991 | Federico |
| 5,037,027 | A | 8/1991 | Nichols |
| 5,119,950 | A | 6/1992 | Takemura |
| 5,295,632 | A | 3/1994 | Zink et al. |
| 5,335,789 | A | 8/1994 | Taravella et al. |
| 5,337,950 | A | 8/1994 | Bower |
| 5,377,857 | A | 1/1995 | Taravella et al. |

(List continued on next page.)

FOREIGN PATENT DOCUMENTS

GB 2 277 731 9/1994

OTHER PUBLICATIONS

FEBRA–Kunststoffe GmbH & Co., Klingenberger Str. 2, D–74336 Brackenheim, Germany, *product brochure and photographs*, (Jan. 1996).

Zink et al., *Reexamination Certificate of U.S. Patent No. 5,295,632 issued Apr. 1998.*

*Primary Examiner*—Gary E. Elkins

(74) *Attorney, Agent, or Firm*—Wood, Herron & Evans, L.L.P.

(57) ABSTRACT

A tote box is disclosed which incorporates a box, four corner enhancers and a multiple piece top rail secured over the top edge of the erected walls of the box. The top rail comprises four corner pieces, two side pieces and two end pieces. The side and end pieces are secured onto the box by hooks which engage tabs extending outwardly from the walls of the box. The corner pieces of the top rail have projections adapted to engage holes in the side and end pieces of the top rail.

19 Claims, 10 Drawing Sheets

U.S. PATENT DOCUMENTS 5,429,261 A * 7/1995 Machino ..... 220/4.28
5,431,336 A 7/1995 Clee
5,462,221 A 10/1995 Zink et al.
5,520,477 A 5/1996 Fink
5,522,539 A * 6/1996 Bazany ..... 229/199
5,531,326 A 7/1996 Hummel et al.
5,538,178 A 7/1996 Zink et al.
6,349,877 B1 * 2/2002 Bradford ..... 229/199
6,460,724 B1 * 10/2002 Bradford ..... 220/642

* cited by examiner

TOTE BOX WITH MULTIPLE PIECE TOP RAIL INCLUDING CORNER PIECES WITH PROJECTIONS

CROSS REFERENCE TO RELATED APPLICATIONS

This application is a continuation-in-part application of U.S. patent application Ser. No. 09/710,872 filed Nov. 13, 2000 entitled "Tote Box With Corner Enhancers and Multiple Piece Top Rail" now U.S. Pat. No. 6,349,887 which is fully incorporated herein. U.S. patent application Ser. No. 09/710,872 claims priority to U.S. provisional patent application serial No. 60/231,110 filed Sep. 8, 2000 entitled "Tote Box With Corner Enhancers and Multiple Piece Top Rail", which is fully incorporated herein. This patent application further claims priority to U.S. design patent application Ser. No. 29/139,643 filed Apr. 4, 2001 entitled "Top Rail Corner Piece", which is both fully incorporated herein.

FIELD OF THE INVENTION

This invention relates to tote boxes and more particularly to tote boxes made from foldable box blanks and having self locking top rails to hold the blanks in an erected, assembled relationship.

BACKGROUND OF THE INVENTION

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of such tote boxes. Such materials typically consist of corrugated paperboard, corrugated plastic sheet, sheet metal and other such materials which are not sufficiently rigid to support a number of filled tote boxes in stacked relation.

Therefore, it is also conventional to reinforce the corners of the tote boxes with structural supports so that a lower tote box of a stack of tote boxes can adequately support the load of the upper tote boxes and goods therein without deformation, possibly resulting in damage to the goods contained therein.

Typically these tote box corner supports and top rails require additional fasteners such as rivets, staples, screws or the like to secure the top rail and the corner support to the box itself. These fasteners add material costs and manufacturing steps to the construction of the tote box thereby resulting in an expensive and difficult to assemble tote box.

One patent which discloses a tote box having corner supports and a top rail which are not held in place with additional fasteners such as rivets, staples, screws or the like is applicants' own U.S. Pat. No. 5,295,632. However, in both embodiments of tote box disclosed in this patent, the tote box blank must have end flaps in order to hold the corner supports in place. The use of end flaps requires additional material to form the box blank, resulting in additional cost to manufacture the tote box.

Accordingly, it is a primary objective of the present invention to provide a tote box made from a box blank, top rail and corner enhancers which facilitates assembly of the tote box without any fasteners and with a minimum of assembly steps and space.

Another objective of this invention has been to provide a tote box which facilitates the stacking of additional tote boxes thereon without deformation of the tote box.

It is an additional objective of the present invention to provide a tote box corner enhancer which can be incorporated into the tote box with a minimum of assembly steps or operations, and which does not require additional fasteners to secure the corner enhancer to the walls of the tote box.

A further object of the present invention has been to reduce the amount of time and expense required to assemble a top edge and corner reinforced tote box.

SUMMARY OF THE INVENTION

The present invention is directed to a tote box which is assembled from a box blank, corner enhancers and a self-locking top rail. When folded into the appropriate shape, the box blank results in a bottom, two opposed end walls, and two opposed side walls. The end walls and side walls have upper edges defining a top edge of the box. A pair of opposed walls preferably have holes into which reinforcing hand holds may be inserted to aid in manual handling of a loaded tote box.

To hold the erected box blank in an assembled relationship and to reinforce the top edge of the tote box, a channel shaped top rail extends around the top edge of the tote box. The top rail comprises multiple pieces including a pair of side pieces, a pair of end pieces and four corner pieces. The side pieces are of a first length and the end pieces of a second length, the first length being greater than the second length typically. However, the side and end pieces may be of an identical length. The side and end pieces of the top rail are preferably manufactured from extruded plastic or aluminum. However, these pieces may be constructed of other materials such as steel, for example.

Each of the side and end pieces of the top rail has a downwardly open channel formed between a pair of channel side walls. This downwardly open channel is at a minimum approximately twice, and preferably three times, the thickness of the box blank. When the downwardly open channel of the piece is pushed down over the top edge of the erected box blank, the channel fits over a double thickness of the tote box formed from tabs or flaps of the box blank. The top rail is locked onto the top edge of the box as the result of a hook extending inwardly from at least one channel side wall which snaps beneath one or more tabs.

The inwardly extending hook engages the tabs thereby securing the top rail over the top edge of the tote box without the need for further fasteners such as screws, rivets, or staples. The side and end pieces of the top rail preferably have a vertical lip which extends upwardly from the rail piece. The vertical lip enables nested stacking of additional tote boxes. A first or upper tote box may be nestably stacked on a second or lower tote box by placing the bottom of the first tote box within the vertical lip of the top rail of the second or lower tote box.

The corner pieces of the top rail are preferably made of molded plastic but may be made of other materials. The corner pieces have a vertical lip like the side and end pieces of the top rail. The hook extending inwardly from at least one channel side wall of the side and end pieces of the top rail snaps beneath a portion of the corner pieces of the top rail, thus securing the multiple pieces of the top rail together.

Structural corner enhancers reside at each corner of the tote box to hold the erected side and end walls together in an assembled relationship and to stiffen the tote box corners. The corner enhancers provide a load path for the weight of the stacked tote boxes and their contents to be distributed downwardly and thereby provide structural integrity to the tote box and prevent side and end wall deformation. Each corner enhancer has a first and second open leg channel, each open leg channel being formed between a pair of leg channel walls. Each of the open leg channels has a width of approximately the thickness of the box blank so that one of the end walls is frictionally held inside one of the open leg channels of a corner enhancer and one of the side walls is frictionally held inside the other open leg channel of the corner enhancer. In this manner, each corner enhancer functions to join together an end wall and a side wall in an orthogonal or right angle relationship. These corner enhancers hold the side and end walls of the box together, without the need for mechanical fasteners.

In order to assemble the tote box of the present invention the die cut box blank is erected and the side and end walls of the erected box blank inserted into the open leg channels of the corner enhancers. A side edge of each side wall and a corresponding side edge of an adjacent end wall are located inside the open leg channels of each of the corner enhancers in order to hold and maintain the walls in an erect vertical position, orthogonal to each other. Once the box blank has been folded and the walls of the box blank inserted into the open leg channels of the corner enhancers at the corners of the box, the corner pieces of the top rail are then snapped in place over the corner enhancers and the side and end pieces of top rail snapped over the upper edges of the box walls.

In an alternative embodiment of the present invention, the tabs of the tote box do not extend downwardly from the upper edges of the box but rather are integrally formed from a pair of opposed side walls, a pair of opposed end walls or all four walls. In this embodiment, the tabs are located below the upper edges of the walls and are defined by cuts, at least portions of which are negative cuts, made in the box walls. Although one configuration of cut is illustrated and described, the cuts may assume many other configurations without departing from the spirit of the invention of this application. Once such cuts are made in the box blank, the tabs are pushed inwardly toward the center of the box. Due to the negative angle of at least a portion of the cut of each tab, the tab is maintained in an extended position and does not return to its original position. Thus, the negative angles on at least a portion of the tabs created by the angle of the cuts keep the tabs directed inwardly, thus providing a catching surface for the inwardly extending hook at the bottom of at least one channel side wall of a piece of the top rail. Tabs maintained in such an extended position ensure that the side and end pieces of the top rail will lock over the upper edges of the side and end walls.

One advantage of the present invention is that the tote box can be assembled rapidly without the need for intermediate fastener joining steps and without the need for multiple rivets or fasteners such as have been conventional in prior art tote boxes as, for example, in the tote box disclosed in the assignee's own earlier U.S. Pat. No. 5,037,027. Another advantage of the present invention is that the stackable tote box may be constructed more quickly and less expensively than is presently possible in competitive type tote boxes.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
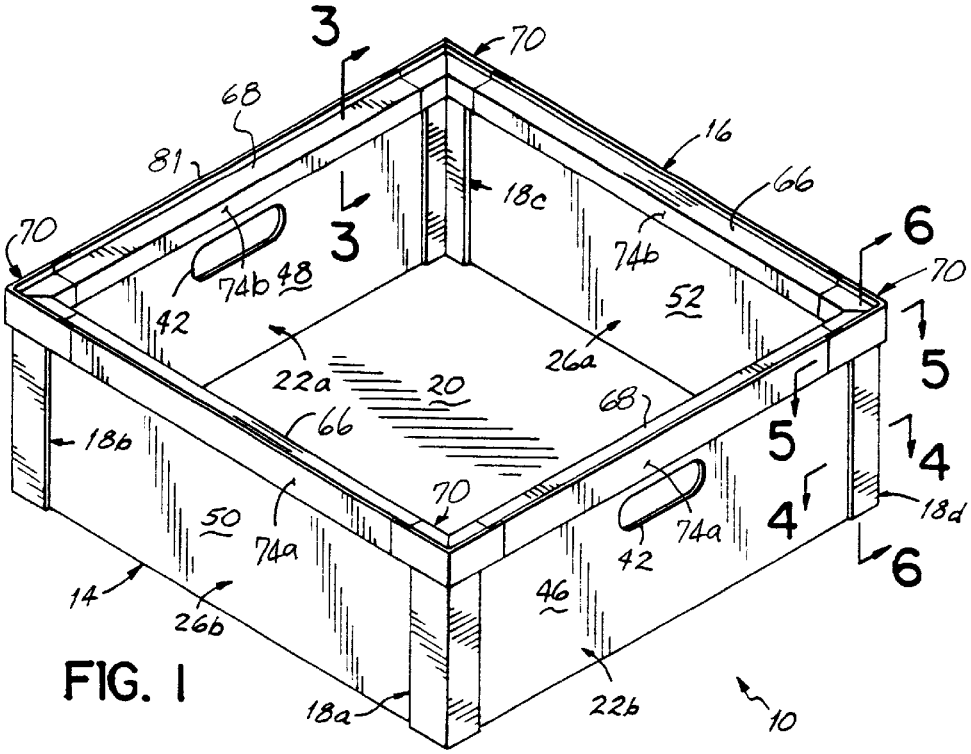
FIG. 1 is a perspective view of the assembled tote box of the present invention.
Figure 2:
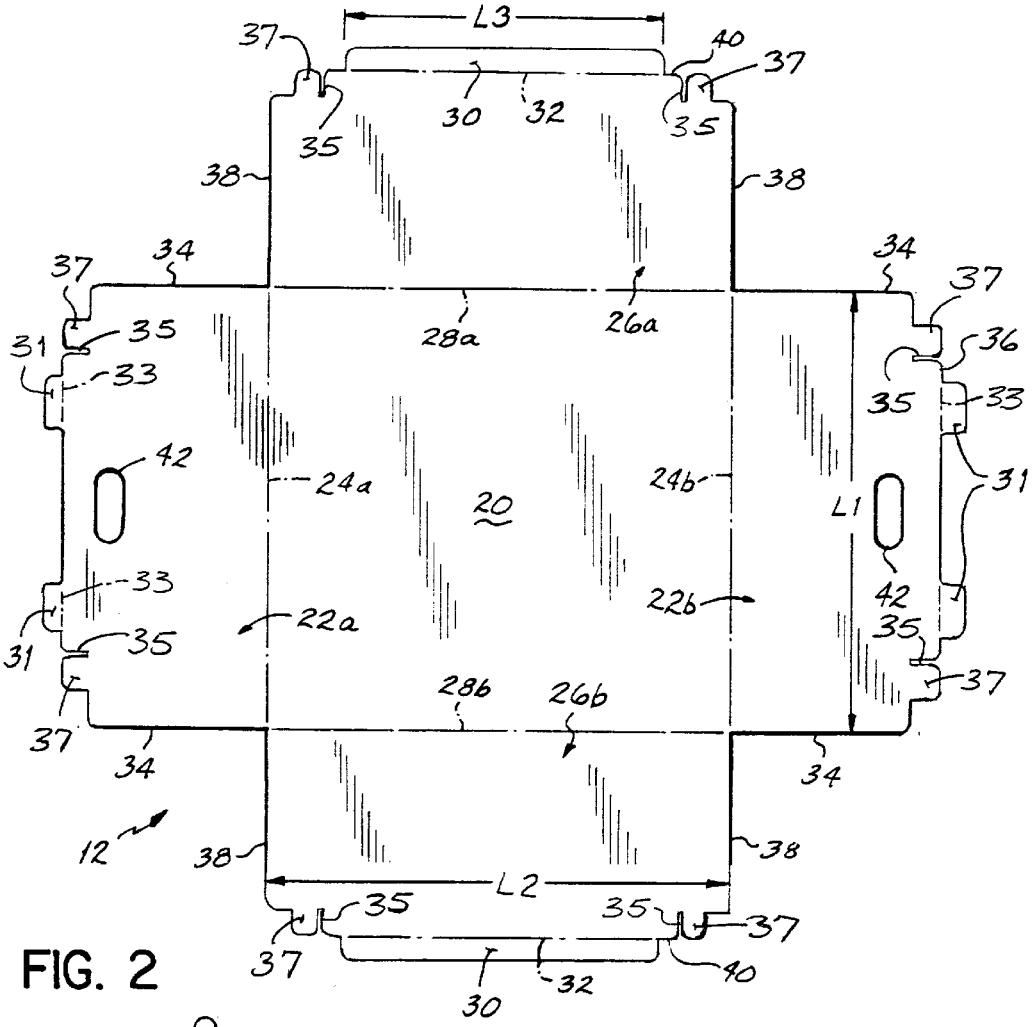
FIG. 2 is a top plan view of a box blank used to form the tote box of FIG. 1.

Referring to FIG. 1, there is illustrated an assembled tote box 10 according to the present invention. The tote box 10 is assembled from a uniform thickness box blank 12 as seen in FIG. 2 which is die cut or otherwise pre-cut from, preferably, corrugated plastic sheet. However, the box blank and resulting box may be made from any other suitable material. In one preferred embodiment, the box blank 12 is 3 millimeters thick and made from extruded corrugated plastic material. Depending upon the application, the box blank may be other thicknesses or materials as well.

Figure 1A:
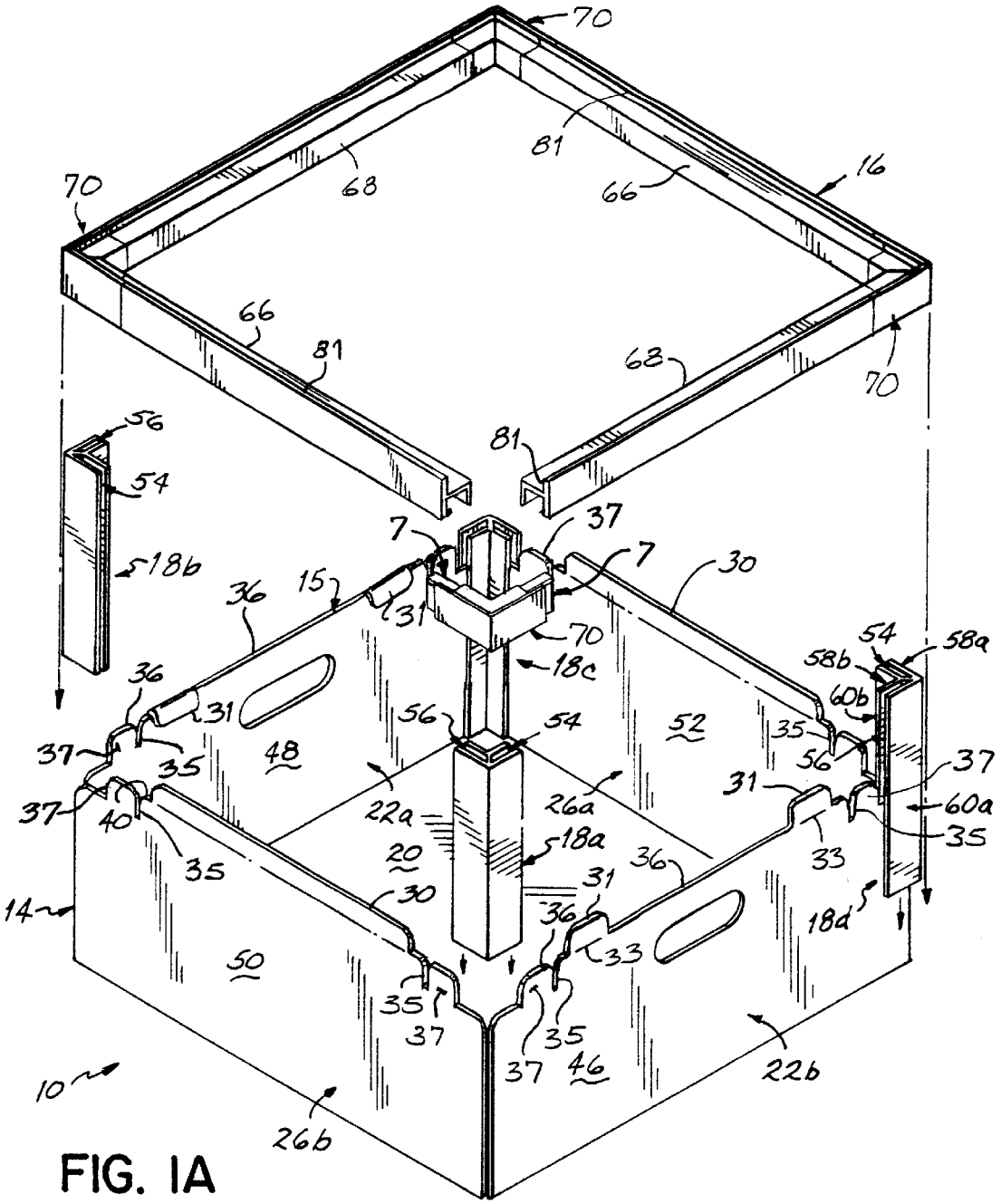
FIG. 1A is a partially disassembled perspective view of the tote box of FIG. 1.

As best illustrated in FIG. 1A, the tote box 10 comprises a box 14 formed from the foldable box blank 12 (shown in FIG. 2), a multiple piece top rail 16, and four corner enhancers 18*a*–18*d*.

Referring to FIGS. 1A and 2, the box blank 12 is folded along fold lines to form a box 14 illustrated in FIG. 1A. As best illustrated in FIG. 2, the box blank 12 has a bottom 20, two end walls 22*a* and 22*b* connected to the bottom with fold lines 24*a* and 24*b*, two side walls 26*a*,26*b* connected to the bottom 20 by fold lines 28*a*,28*b*. In one preferred embodiment, each of the side walls 26*a*,26*b* has a tab 30 which is joined to the wall with a fold line 32. Similarly, each of the end walls 22*a*,22*b* has a pair of spaced tabs 31 joined to the end wall with fold lines 33. However, it is within the contemplation of the present invention that the side walls or end walls have any number of tabs at various locations.

As best illustrated in FIGS. 1A and 2, each end wall 22*a*,22*b* has a pair of opposed side edges 34 and an upper edge 36. Similarly, each of the side walls 26*a*,26*b* has a pair of opposed side edges 38 and an upper edge 40.

Figure 1B:
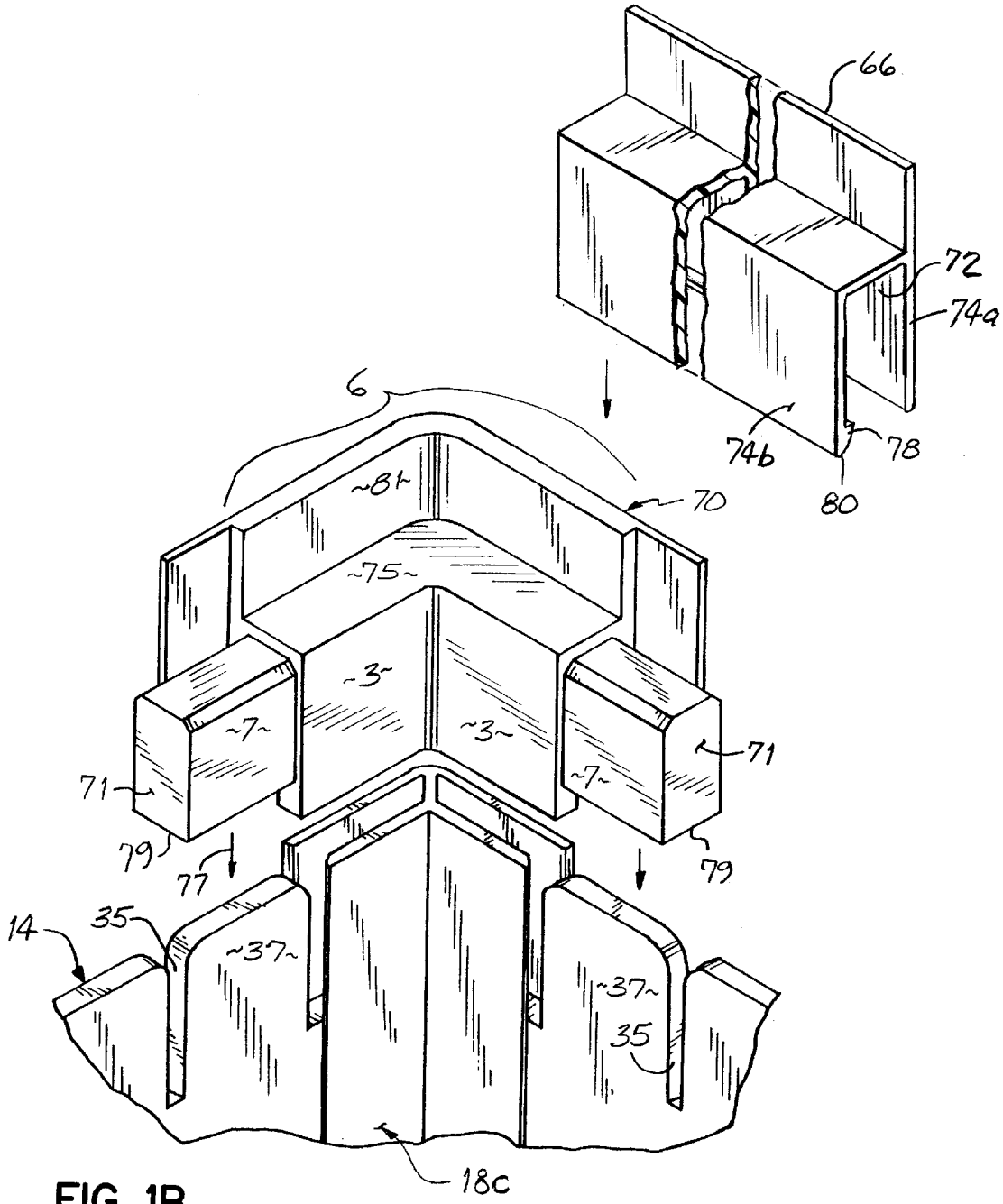
FIG. 1B is a partially disassembled perspective view of a corner piece of the top rail being secured to adjacent tote box walls and a portion of an end piece of the top rail being secured to the corner piece.

As best illustrated in FIGS. 1A, 1B and 2, each of the walls has a pair of slits 35 extending downwardly from the upper edge of the wall. Located just outside each slot 35 is an outer portion 37 of the wall.

As best illustrated in FIG. 2, each of the opposed end walls 22*a,b* has an identical first length L1, and each of the opposed side walls 26*a,b* have an identical length L2. In one preferred embodiment of the present invention illustrated in FIG. 2, the lengths L1,L2 of the end walls 22*a,b* and side walls 26*a,b*, respectively are identical, resulting in a square box 14. However, for purposes of the present invention they may be of different lengths in order to create a rectangular box rather than a square box.

Oval shaped holes 42 are cut through the end walls 22*a*,22*b* and may accommodate hand holds (not shown) which preferably are fabricated from plastic or aluminum but be constructed of any material. Although the holes 42 are illustrated as being formed in the end walls, they may alternatively be placed in the side walls 26*a*,26*b* or in all four walls.

As best illustrated in FIG. 2, each of the tabs 30 has a length L3 less than the length of the side walls L2 in order to leave space proximate the corners for the corner enhancers 18*a–d*. Similarly, tabs 31 are spaced inwardly from the side edges 34 of the end walls 22*a,b* in order to leave space proximate the corners for the corner enhancers 18*a–d*. In either case, the tabs 30,31 do not interfere with the insertion and function of the corner enhancers 18*a–d*.

As best illustrated in FIG. 1A, once the end walls 22*a,b* of the box blank are folded along fold lines 24*a,b* into a generally vertical orientation, the ends walls 22*a*,22*b* each have an outside surface 46 and an inside surface 48. Similarly, once the side walls 26*a,b* are folded along fold lines 28*a,b* each of the side walls 26*a*,26*b* has an outside surface 50 and inside surface 52.

Figure 4:
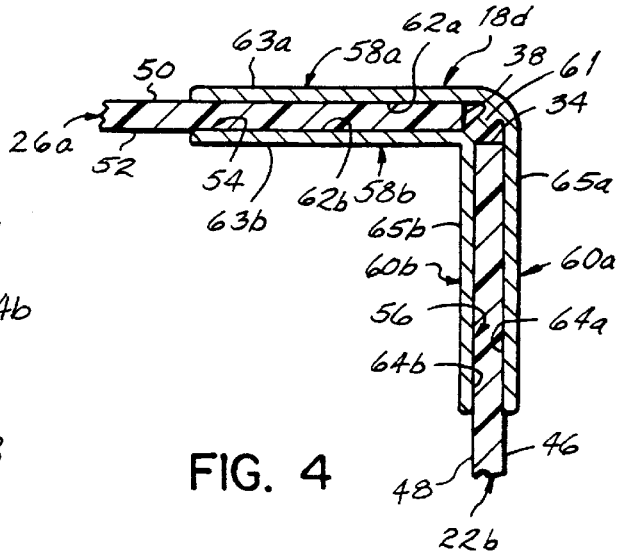
FIG. 4 is a cross-sectional view taken along the line 4—4 of FIG. 1.

Each of the corner enhancers 18*a*–18*d* is identically configured and has a first open leg channel 54 and a second open leg channel 56. FIG. 4 illustrates corner enhancer 18*d*. The first open leg channel 54 is formed between a pair of leg channel walls 58*a,b* and second open leg channel 56 is formed between a pair of leg channel walls 60*a,b*. The first and second open leg channels of each corner enhancer are separated by a separator 61. Leg channel wall 58*a* has an inside surface 62*a* and an outside surface 63*a*, respectively. Likewise, leg channel wall 58*b* has an inside surface 62*b* and an outside surface 63*b*, respectively. The distance between the inside surfaces 62*a* and 62*b* of the leg channel walls 58*a,b* defines the width of the first open leg channel 54, which is approximately the thickness of the box blank 12. Likewise, the leg channel wall 60*a* of the second open leg channel 56 has an inside surface 64*a* and an outside surface 65*a*, respectively. Leg channel wall 60*b* of the second leg channel 56 also has an inside surface 64*b* and an outside surface 65*b*. The distance between the inside surfaces 64*a* and 64*b* of the leg channel walls 60*a*,60*b* defines the width of the second open leg channel 56, which is also approximately the thickness of the box blank 12.

Because the width of the first and second open leg channels are approximately equal and approximately equal to the thickness of the side and end walls of the box blank, one of the end walls 22*a,b* and one of the side walls 26*a,b* are frictionally held inside the open leg channels of each corner enhancer. One of the open leg channels of each corner enhancer receives one of an adjacent side wall and end wall while the other open leg channel of the corner enhancer receives the other one of the adjacent side wall and end walls.

For example, as illustrated in FIGS. 1A and 4, corner enhancer 18*d* joins together end wall 22*b* and side wall 26*a*, a portion of end wall 22*b* including side edge 34 being received within the second open leg channel 56 while a portion of side wall 26*a* including side edge 38 is received within the first open leg channel 54 of the corner enhancer 18*d*. Thus, each corner enhancer 18*a–d* functions to hold and maintain one of the end walls and one of the side walls in an orthogonal relationship in order to maintain the structural integrity of the box without the need for separate fasteners before the top rail 16 is placed over the box 14 and corner enhancers 18*a–d*.

Each corner enhancer 18*a–d* preferably has a height equal to the distance between the bottom 20 of box 14 and the top edge 15 of the box 14 (see FIG. 1A). However, corner enhancers of alternative heights may be used in accordance with the present invention.

Although one configuration of corner enhancer is illustrated and described, other configurations of corner enhancers may be used in accordance with the present invention. For example, each corner enhancer may comprise an "L-shaped" inner piece and an "L-shaped" outer piece held together, the distance between the inner and outer pieces defining a pair of open leg channels of a width approximately equal to the thickness of the box blank.

To assemble the box 14 illustrated in FIG. 1A from the box blank 12 illustrated in FIG. 2, the end walls 22*a*,22*b* are first folded upwardly along fold lines 24*a*,24*b*, respectively. Next, the side walls 26*a*,26*b* are folded upwardly along fold lines 28*a*,28*b*, respectively. Once the side walls and end walls are erected, at each corner one of the side walls 26*a,b* is inserted into one of the open leg channels of one of the corner enhancers and one of the end walls 22*a,b* is inserted into the other open leg channel of the corner enhancer in order to hold and maintain one of the end walls and one of the side walls in an orthogonal vertical orientation or position. Because each of the open leg channels has a width of approximately the thickness of the box blank, each of the end walls and side walls are frictionally held inside one of the open leg channels of one of the corner enhancers. Once the walls are erected and held together with the corner enhancers 18*a–d*, the tabs 30,31 extending upwardly from each of the side and end walls are folded downwardly, either inwardly or outwardly. Although FIG. 1A illustrates a pair of tabs 31 folded inwardly of end wall 22*b*, at least one or all of the tabs 30,31 may be folded outwardly of their respective side or end walls.

Once the side walls and end walls of the tote box are erected and partially inserted into the open leg channels of the corner enhancers and the tabs folded downwardly, the final step in the assembly of the tote box is accomplished by locating the top rail 16 over the top edge of the erected box. The top edge 15 of the tote box 14 is formed from upper edges 36 of end walls 22*a,b* and upper edges 40 of side walls 26*a,b*, respectively. Prior to securing the top rail 16, the tabs 30,31 must be folded downwardly. Once the tabs 30,31 are folded downwardly, the top rail 16 is placed over the top edge of the erected tote box one piece at a time.

As best illustrated in FIG. 1A the top rail 16 is made up of multiple pieces: a pair of opposed side pieces 66, a pair of opposed end pieces 68 and four corner pieces 70. As best illustrated in FIG. 1A, each corner piece 70 joins one side piece 66 to an adjacent end piece 68 of the top rail in an orthogonal relationship. As best illustrated in FIG. 1B, each corner piece 70 also functions to join one side wall to an adjacent end wall of the box 14 in an orthogonal relationship. Each corner piece 70 is preferably configured as shown in a pending U.S. design patent application serial number 29/129,095 filed Sep. 7, 2000 entitled "Tote Box Top Rail Corner" which application is fully incorporated by reference herein. However other designs of corner pieces may be utilized in accordance with the present invention such as the one shown in pending U.S. design patent application serial number 29/129,261 filed Sep. 11, 2000 entitled "Top Rail Corner Piece".

As shown in FIG. 1B, each corner piece 70 has a central portion 6, a pair of outer portions 7, each outer portion 7 terminating in an end wall 71, and a lip 81 extending upwardly from a top wall 75. The end walls 71 are adapted to be received in slots 35 formed in the end and side walls of the box 14. The engagement of the end walls 71 of the corner piece 70 with the slots 35 maintains adjacent walls in an orthogonal relationship and prevents the end and side walls of the box 14 from separating from the open leg channels 54,56 of the corner enhancers 18*a–d*.

Figure 6:
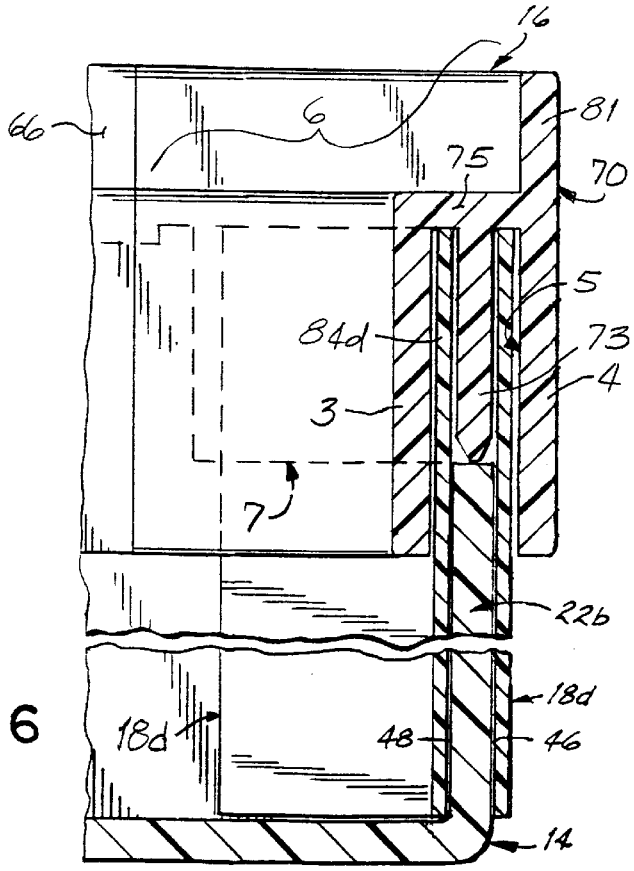
FIG. 6 is a cross-sectional view taken along the line 6—6 of FIG. 1.
Figure 1C:
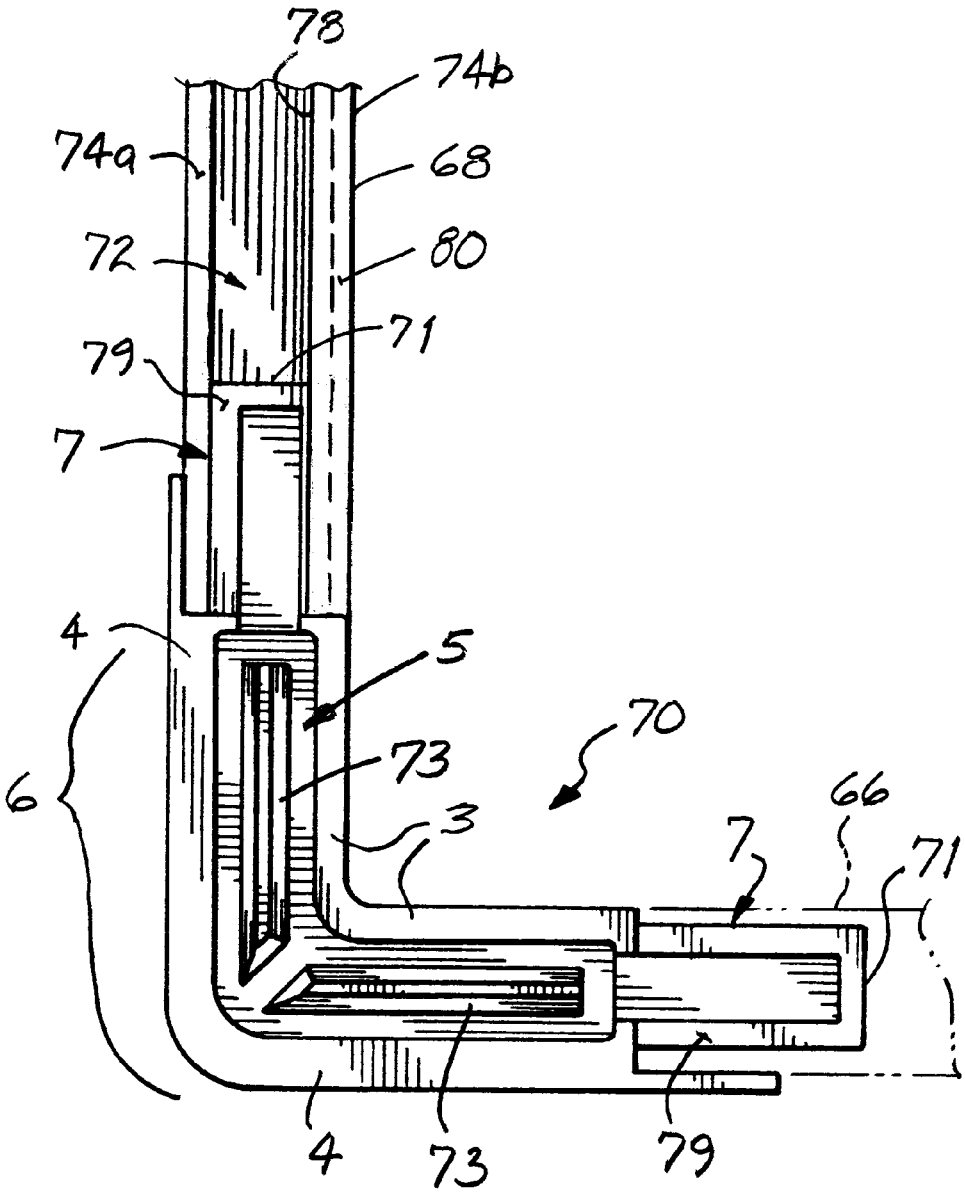
FIG. 1C is a bottom view of a portion of the top rail including one corner piece of the top rail.

As best illustrated in FIGS. 1C and 6, each corner piece 70 also has a pair of projections 73 therein which extend downwardly from the top wall 75 of the corner piece 70. As shown in FIG. 6, the projections 73 are received within the first and second open leg channels 54,56 of the corner enhancers 18*a*–18*d* to limit movement of the corner piece 70 of the top rail 18 relative to the corner enhancer below it.

Of the multiple pieces of the top rail, the corner pieces 70 are the first pieces to be attached to the erected box. As illustrated in FIG. 1B, by lowering a corner piece 70 downwardly in the direction of arrows 77 the projections 73 of the corner piece 70 pass into the open leg channels 54,56 of the corner enhancer and the end walls 71 of the corner piece 70 pass into the slots 35 formed in the box walls, thus providing structural stability to the corner and further preventing adjacent walls from separating from one another. Once all four corner pieces 70 of the top rail 16 are secured in place, the side pieces 66 and the end pieces 68 of the top rail are then moved downwardly and snapped into engagement with the corner pieces 70 of the top rail.

Figure 3:
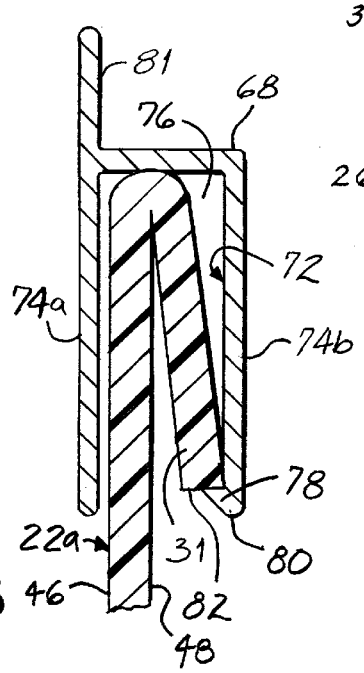
FIG. 3 is a cross-sectional view of a top rail and tote box wall taken on line 3—3 of FIG. 1.

As shown in FIG. 3, each side piece 66 and each end piece 68 of the top rail 16 has a downwardly open channel 72 which is formed between two spaced channel side walls 74*a,b*. The channel 72 has an opening 76 of a width at least twice the thickness of the box blank and in one preferred embodiment, approximately three times the thickness of the box blank. As seen in FIG. 3, the channel opening 76 is of sufficient width to accommodate the end wall 22*a* and tabs 31 folded inside thereof.

As illustrated in FIG. 3, an inwardly extending hook 78 is provided on a bottom portion 80 of channel side wall 74*b* in one preferred embodiment.

The hook 78 may alternatively be placed on channel side wall 74*a* to engage outwardly turned tabs. The hook 78 is illustrated as being at the bottom of a channel side wall but may be located at other locations such as midway up the channel side wall. When the side piece 68 of the top rail 16 is snapped onto the erected tote box, hook 78 engages the bottom edges 82 of the downwardly folded tabs 31 thereby securing the top rail piece 68 on the erected tote box as shown in FIG. 3. Once the pieces of the top rail 16 are pressed onto the top edge of the tote box and the hooks 78 engage the downwardly folded tabs of the side and/or end walls, the tote box is erected without the benefit of mechanical fasteners, rivets, staples, or the like.

While the tabs 31 are illustrated in FIG. 3 as being folded downwardly on the inside of the side wall 22*a*, they could just as well be folded downwardly on the outside of this same wall. Although FIG. 3 illustrates an inwardly extending hook 78 on a bottom portion 80 of one channel side wall 74*b*, alternatively, channel side wall 74*a* or both of the channel side walls 74*a,b* could have an inwardly extending hook 78.

As illustrated in FIG. 1C, the inwardly extending hook 78 formed on at least one channel side wall of the side and end pieces of the top rail preferably extends the entire length of the piece. Thus, as illustrated in FIGS. 1B and 1C, the inwardly extending hook 78 engages a lower surface 79 of the outer portions 7 of the corner pieces 70 of the top rail (only one corner piece being illustrated in FIG. 1C). The engagement of the hook 78 of the side and end pieces of the top rail with the corner pieces 70 of the top rail prevents the side and end pieces of the top rail from separating from the erected box. Thus, if a piece of the top rail is not engaged with one or more tabs, the top rail piece may not be pulled upwardly away from the tote box due to the engagement of the hook with the lower surfaces 79 of the outer portions 7 of the corner pieces 70 located at the ends of the top rail side or end piece.

Figure 5:
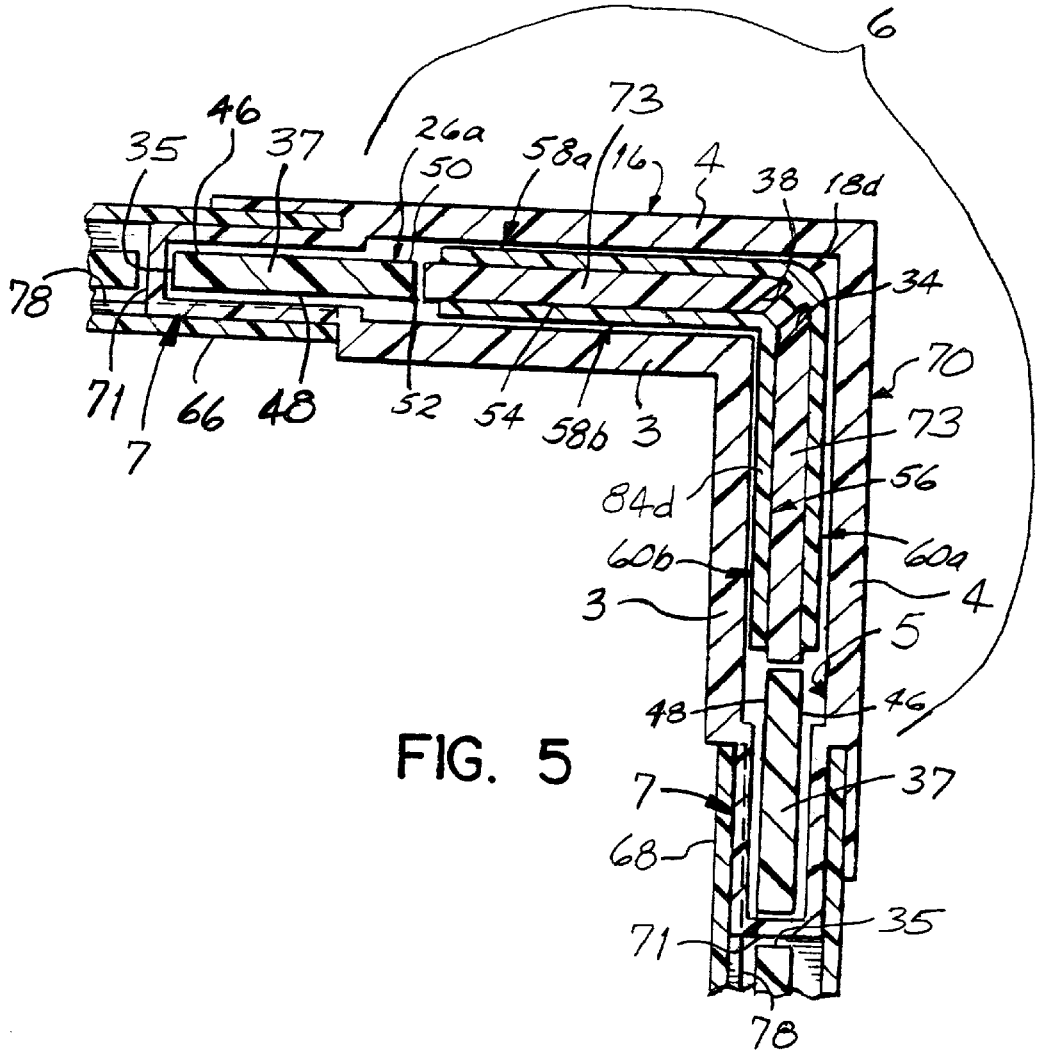
FIG. 5 is a cross-sectional view taken along the line 5—5 of FIG. 1.

As illustrated in FIGS. 5 and 6, each of the corner enhancers 18*a–d* has an upper portion 84*a–d* (only upper portion 84*d* being illustrated in FIGS. 5 and 6). These upper portions 84*a–d* of the corner enhancers 18*a–d* are located inside the downwardly open channel 5 formed between inner and outer walls 3,4 of the corner pieces 70 of top rail 16 as best illustrated in FIG. 6.

Each of the side pieces 66, end pieces 68 and corner pieces 70 of the top rail 16 of the present invention also has a vertically extending lip 81 on an outside upper edge thereof. The lip 81 facilitates the stacking of a second tote box in a nested relationship upon the tote box 10 of the present invention.

The weight of the tote box stacked on the top rail 16 is distributed around the top rail 16 and supported by the corner enhancers 18*a–d* of the present invention. Although one configuration of top rail 16 is illustrated and described, the top rail 16 may assume other configurations as well, such as for example slots may be formed in the vertical lip 81 of the top rail 16 to receive strapping.

Figure 7:
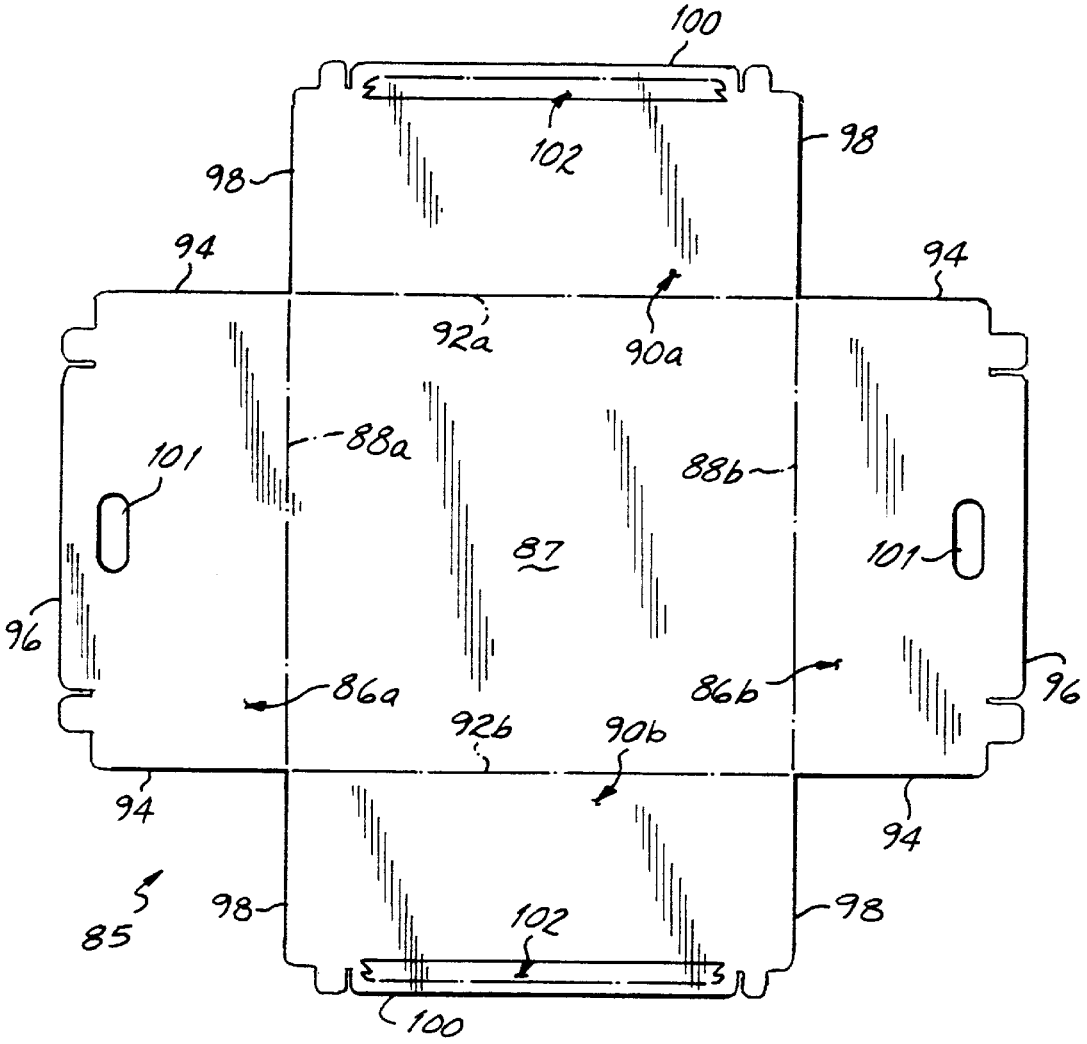
FIG. 7 is a top plan view of a box blank used to form an alternative embodiment of tote box of the present invention.

Referring to FIG. 7, there is illustrated an alternative preferred embodiment. This embodiment comprises a box blank 85 configured similarly to the box blank 12 illustrated in FIG. 2. The box blank 85 has a bottom 87, two end walls 86*a* and 86*b* connected to the bottom with fold lines 88*a* and 88*b*, and two side walls 90*a* and 90*b* connected to the bottom 87 with fold lines 92*a* and 92*b*. Each end wall 86*a*,86*b* has a pair of opposed side edges 94 and an upper edge 96. Similarly, each side wall 90*a*,90*b* has a pair of opposed side edges 98 and an upper edge 100. Holes 101 are formed in a pair of opposed walls as illustrated or in all four walls.

In this preferred embodiment of the present invention, each of the side walls 90*a*,90*b* has a tab 102 formed therein. The tab 102 is spaced inwardly from the upper edge 100 of the side wall so that when the box walls are folded upwardly into a vertical orientation, the tabs 102 are below the upper edges 100 of the side walls 90*a*,90*b*. Although the tabs 102 are illustrated as being on a pair of opposed side walls, they may be located on opposed end walls only, or on all four walls of the box. In this embodiment the tabs 102 are illustrated having a length slightly less than the length of the side walls so as to not interfere with the corner enhancers. However, the tabs 102 may be any length desired.

Figure 8:
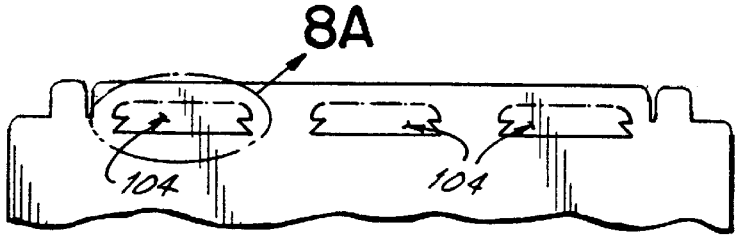
FIG. 8 is a plan view of a portion of a box blank illustrating yet another alternative embodiment of the present invention.

FIG. 8 illustrates an alternative embodiment of the present invention in which each side wall has three tabs 104 rather than one continuous tab 102 as illustrated in FIG. 7. Again, such a series of tabs may be located on a pair of opposed end walls, on a pair of opposed side walls, or on all four walls.

Figure 8A:
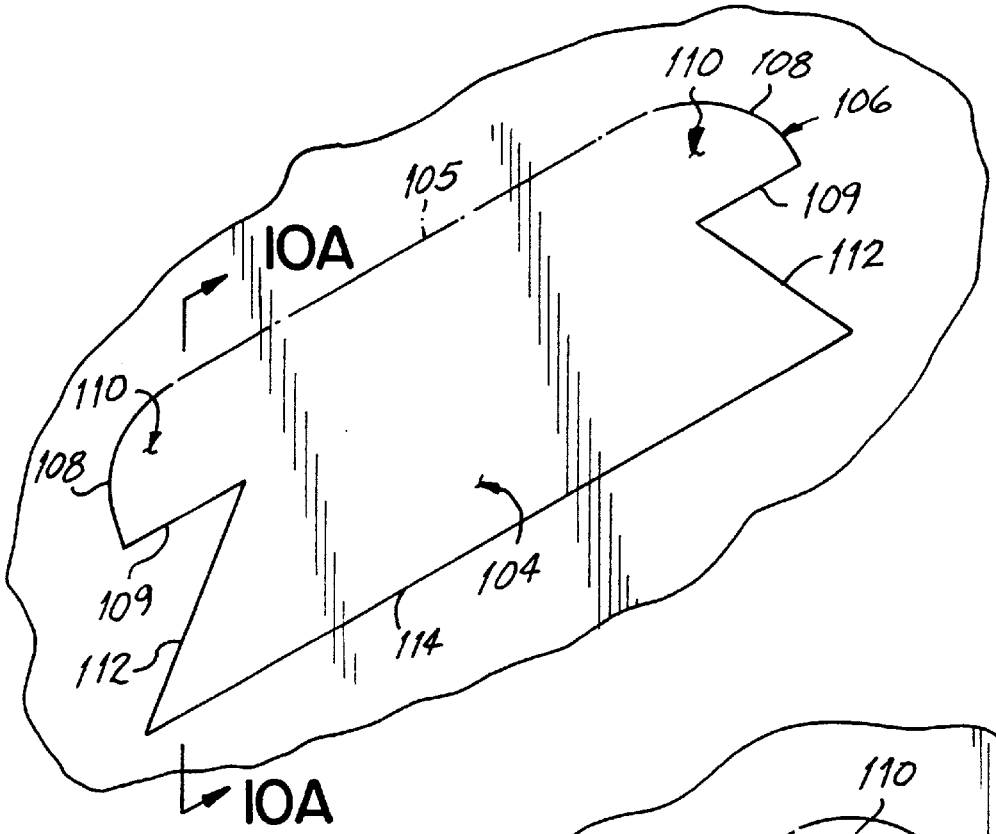
FIG. 8A is a perspective view of the encircled area 8A of FIG. 8.
Figure 8B:
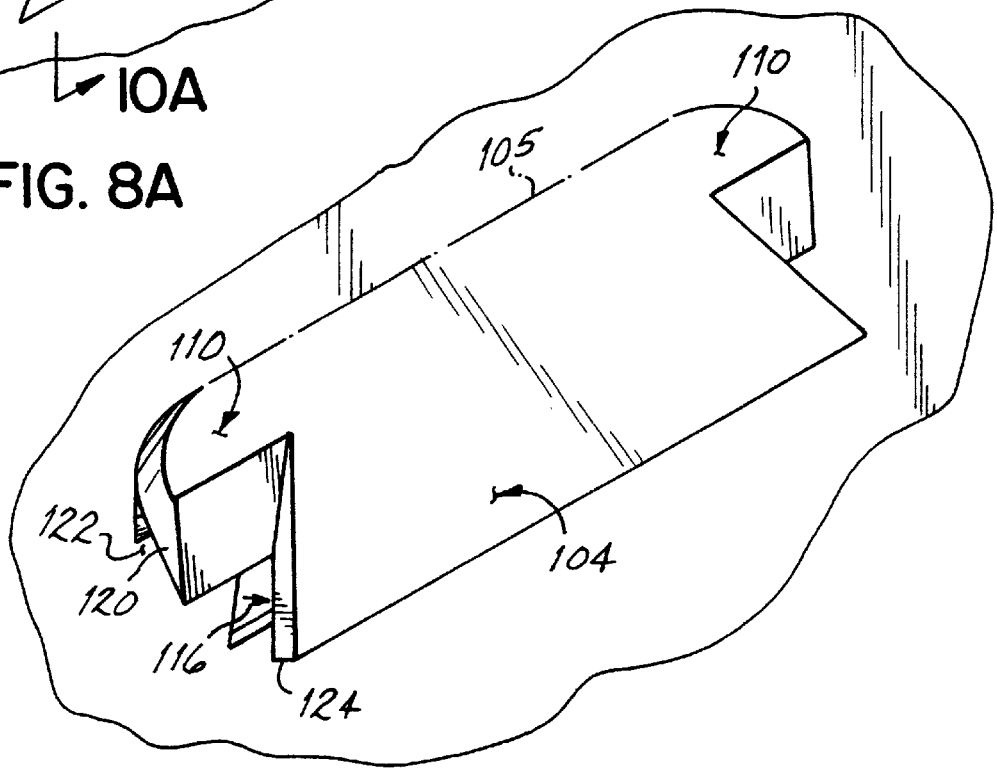
FIG. 8B is a perspective view of the tab of FIG. 8A pushed inwardly.
Figure 8C:
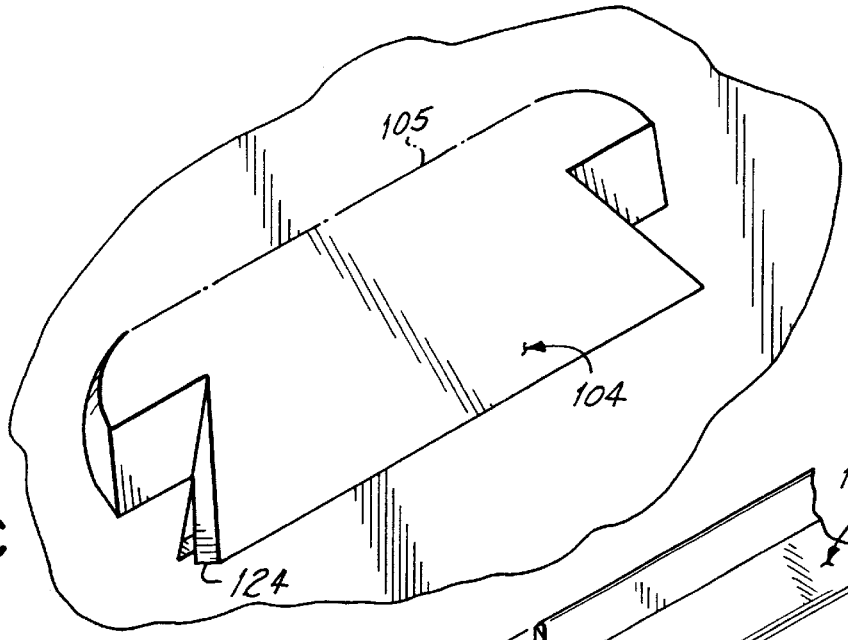
FIG. 8C is a perspective view of the tab of FIG. 8A in an at-rest position.
Figure 9:
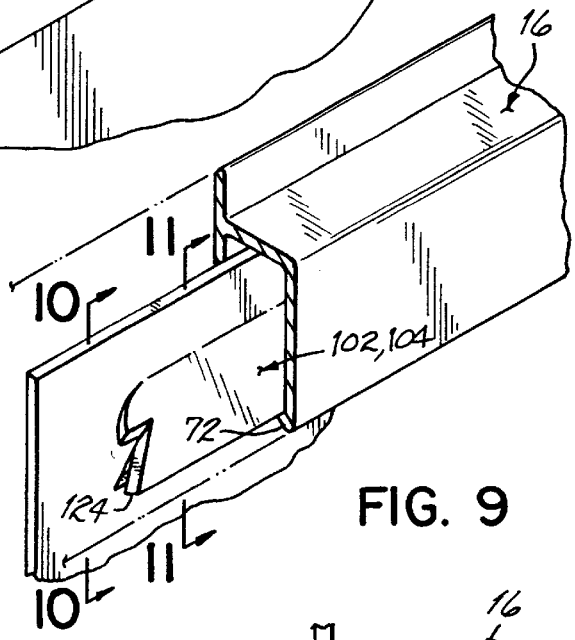
FIG. 9 is a perspective view of a tab engaged with the top rail of the present invention.

FIGS. 8A–8C illustrate the method by which the tabs 104 are moved from an inactive position illustrated in FIG. 8A to an active position illustrated in FIG. 8C. In an active position, the tab 104 functions to hold the top rail 16 over the top edge of the box as described hereinabove. Referring to FIG. 8A, the tab 104 is defined by a fold line 105 at the top of the tab 104 and a multi-surface cut 106 through the material of the box blank defining the lower edge of the tab 104. The multi-surface cut 106 comprises a pair of first portions 108 which are normal or perpendicular to the surface of the box blank, a pair of second portions 109 which are cut at a negative angle 118 to the surface of the box blank, third portions 112 which are cut perpendicular to the surface of the box blank and a bottom fourth portion 114 which is normal to the surface of the box blank.

Referring to FIG. 8B, once the cut 106 is made through the material of the box blank, the tab 104 is pushed in the direction of arrow 116 about fold line 105 so that the tab 104 moves inwardly toward the center of the assembled box.

Figure 10:
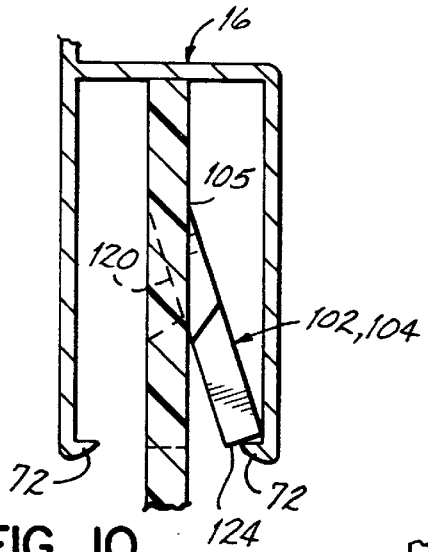
FIG. 10 is a cross-sectional view taken along the line 10—10 of FIG. 9.
Figure 10A:
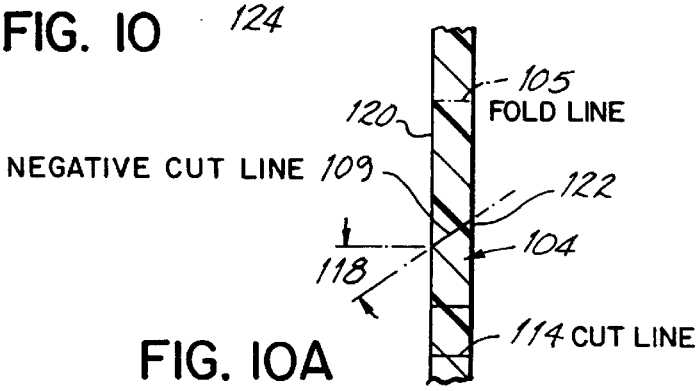
FIG. 10A is a cross-sectional view taken on line 10A—10A of FIG. 8A.
Figure 11:
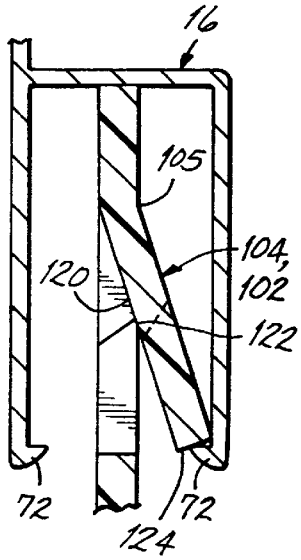
FIG. 11 is a cross-sectional view taken along the line 11—11 of FIG. 9.

Referring to FIG. 8C, once the tab 104 has been pushed inwardly from the plane of the box blank, the tab 104 is maintained in an extended, active position as illustrated in FIG. 8C due to the top portions 110 of the tab 104 (defined by the cuts 108,109) having the surface of cut 109 cut at a negative angle 118 as best illustrated in FIGS. 10, 10A and 11. Thus, as illustrated in FIGS. 10, 10A and 11, a first surface 120 of the tab 104 abuts against the inside surface 122 of the box wall. Due to the negative angle 118 along at least the top portion 110 of the tab, the tab 104 is prevented from returning to its original position illustrated in FIG. 8A and is maintained in an extended, active position.

In its extended position, when the top rail 16 is placed over the top edge of the box the hook of one of the opposed side channel walls of the top rail 16 catches on the bottom surface 124 of the tab 104 so that the top rail 16 may not be removed without pushing inwardly on the tabs. Thus, due to the negative angle of at least one portion of the cut which is made to create a tab, the tab, once pushed out, is maintained in an extended position in which it will catch a hook on the bottom of one of the channel side walls of the top rail and prevent the top rail from being removed from the box.

Figure 12:
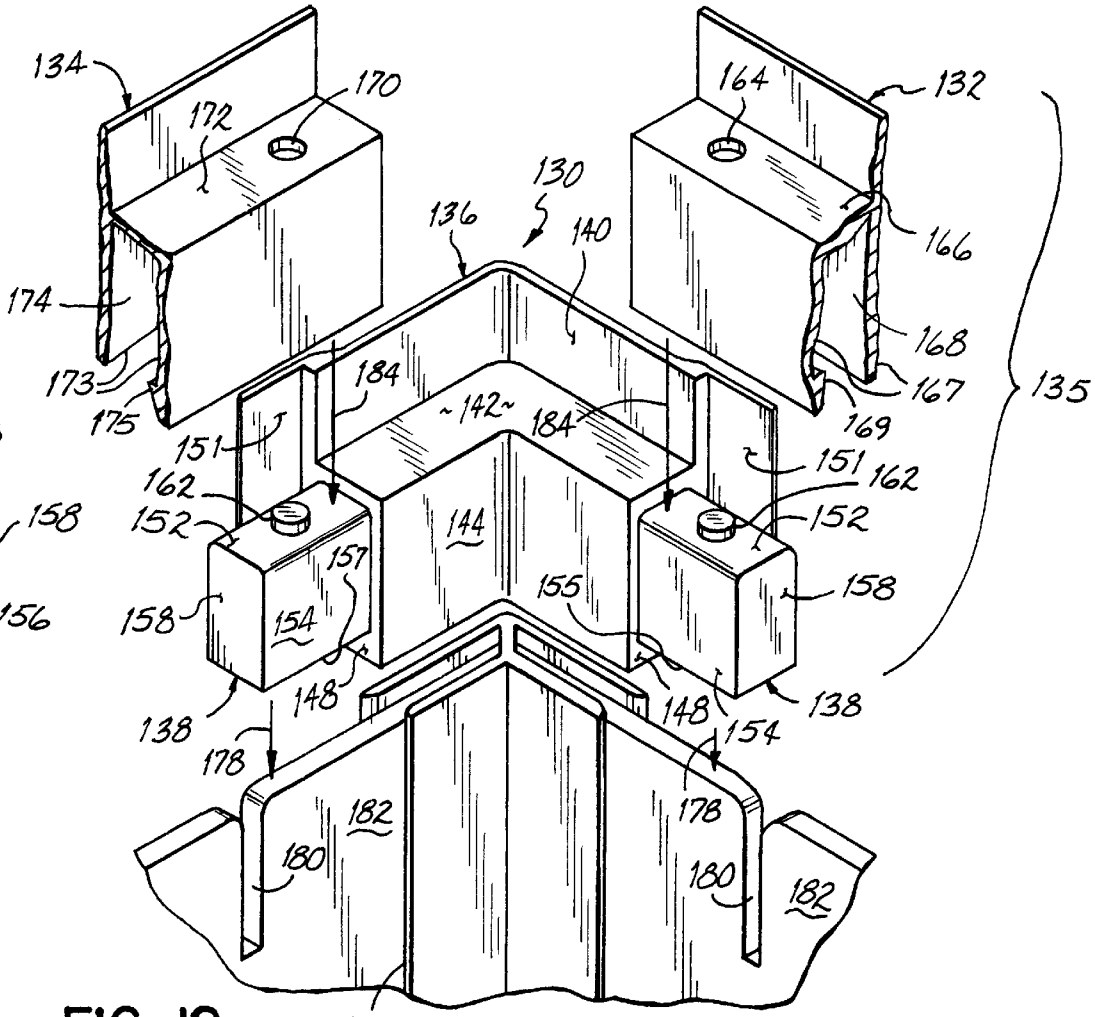
FIG. 12 is a disassembled perspective view of a corner of a tote box, illustrating one embodiment of the present invention.
Figure 13:
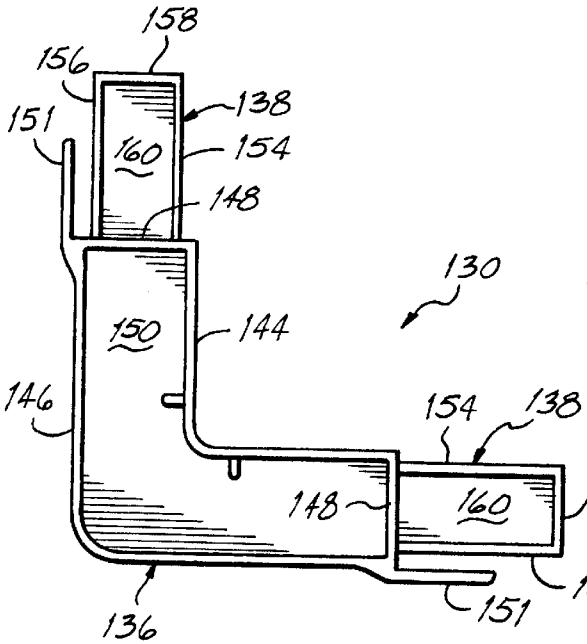
FIG. 13 is a bottom view of the corner piece of FIG. 12.

FIGS. 12 and 13 illustrate another preferred embodiment of the present invention. FIG. 12 illustrates a corner piece 130, a side piece 132 and an end piece 134 of a top rail 135. In this embodiment, each corner piece 130 has a central portion 136, a pair of outer portions 138 and a lip 140. The central portion 136 has a top wall 142, an inner wall 144, an outer wall 146 and a pair of end walls 148 defining a hollow interior 150. See FIG. 13. The outer wall 146 of the central portion 136 has extensions 151 located outside the outer portions 138 of the corner piece. Each outer portion 138 has a top wall 152, an inner wall 154, an outer wall 156 and an end wall 158 defining a hollow interior 160. See FIG. 13. A projection 162 extends upwardly from the top wall 152 of each outer portion 138 of each corner piece 130. Although one configuration of projection 162 is illustrated shaped like a button, the projection 162 may assume numerous other configurations or shapes in accordance with the present invention.

In this preferred embodiment, each of the side pieces 132 of the top rail has at least one hole 164 extending through a top wall 166 of downwardly open channel 168. Preferably, each side piece 132 has two holes 164, one at each end thereof to engage two corner pieces 130. However, each side piece 132 may have any number of holes 164 formed therein at any desired location.

Similarly, each of the end pieces 134 of the top rail has at least one hole 170 extending through a top wall 172 of downwardly open channel 174. Preferably each end piece 134 has two holes 170, one at each end thereof to engage two corner pieces 130. However, each end piece 134 may have any number of holes 170 formed therein at any desired location.

In use, after the corner enhancers 176 have been located as described hereinabove, the corner pieces 130 of the top rail 135 are lowered in the direction of arrows 178, the end walls 158 of the outer portions 138 of the corner pieces passing into slots 180 in the box walls 182. The side pieces 132 are then lowered in the direction of arrows 184, the outer portion 138 of the corner piece 130 entering the downwardly open channel 168 of the side piece 132 and the projection 162 of the corner piece 130 engaging the hole 164 in the side piece 132. This engagement of the projection 162 of the corner piece 130 with the hole 164 in the side piece 132 locks the corner piece 130 and side piece 132 together at one end of the side piece. This process is repeated for each side piece 132 and then for each end piece 134.

Alternatively, the end pieces 134 may be secured to the corner pieces 130 before the side pieces 132. Under this scenario, the end pieces 134 are lowered in the direction of arrows 184, the outer portion 138 of the corner piece 130 entering the downwardly open channel 174 of the end piece 134 and the projection 162 of the corner piece 130 engaging the hole 170 in the end piece 134. This engagement of the projection 162 of the corner piece 130 with the hole 170 in the end piece 134 locks the corner piece 130 and end piece 134 together at one end of the end piece 134. This process is repeated for each end piece 134 and then for each side piece 132. Alternatively, all side and end pieces 132, 134 of the top rail 135 may be lowered and secured to the corner pieces 130 of the top rail 135 simultaneously.

Each of the side pieces 132 has a pair of channel side walls 167 extending downwardly from the top wall 166. At least one of the channel side walls 167 has a hook 169 extending inwardly toward the downwardly open channel 168. The hook 169 is adapted to engage tabs (not shown) in a manner described hereinabove. In addition, the hook 169 engages the outer portions 138 of corner pieces 130 of the top rail 135. More specifically, the hook 169 engages the lower edge 155 of the inner wall 154 of the outer portion 138 of the corner piece 130 of the top rail 135.

Similarly, each of the end pieces 134 has a pair of channel side walls 173 extending downwardly from the top wall 172.

At least one of the channel side walls 173 has a hook 175 extending inwardly toward the downwardly open channel 174. The hook 175 is adapted to engage tabs (not shown) of the box walls in a manner described hereinabove. In addition, the hook 175 engages the outer portions 138 of corner pieces 130 of the top rail 135. More specifically, the hook 175 engages the lower edge 157 of the inner wall 154 of the outer portion 138 of the corner piece 130 of the top rail 135.

While we have described several preferred embodiments of the present invention, persons skilled in the art will appreciate changes and modifications which may be made without departing from the spirit of the invention. For example, the downwardly folded tabs may be located on only two opposed walls of the tote box rather than on all four walls to effectively secure the top rail to the tote box. Additionally, the inwardly folded tabs of the second embodiment may be located on all four walls of the tote box to effectively secure the top rail to the tote box or on only two opposed sides of the tote box. Therefore, we intend to be limited only by the scope of the following claims and equivalents thereof:

We claim:

1. A tote box with a self-locking top rail comprising:

a box formed from a foldable box blank of a uniform thickness, said box having a bottom, two opposed side walls and two opposed end walls, said side walls and end walls having upper edges defining a top edge of the box, a plurality of corner enhancers, each of said corner enhancers having first and second open leg channels, each open leg channel being formed between a pair of leg channel walls, each of said open leg channels having a width defined between planar inside surfaces of said leg channel walls, said width of said open leg channels being substantially the same as the thickness of the box blank, one of said end walls being located inside one of said first and second open leg channels and one of said side walls being located inside the other of said first and second open leg channels, and a top rail extending around the top edge of said box, said top rail comprising two side pieces, two end pieces and four corner pieces, each of said side pieces and each of said end pieces of said top rail having a downwardly open channel defined by a top and a pair of channel side walls extending downwardly from said top, said downwardly open channel having holes formed therein, each of said corner pieces of said top rail having projections for engaging said holes of said side pieces and said end pieces of said top rail and locking said pieces of said top rail together.

2. The tote box of claim 1 wherein at least two of said walls of said box have at least one tab for engaging said top rail.

3. The tote box of claim 1 wherein each of said walls of said box has at least one tab for engaging said top rail.

4. The tote box of claim 1 wherein said foldable box blank is made of corrugated plastic sheet.

5. The tote box of claim 1 wherein said corner enhancers are extruded.

6. The tote box of claim 1 wherein said pieces of said top rail have a vertical lip on an outside upper edge thereof for facilitating stacking of a second tote box on top of said tote box.

7. The tote box of claim 2 wherein said tabs are defined by cuts made in said walls of said box.

8. The tote box of claim 2 wherein said tabs are maintained in an extended position by negative angles formed on said tabs by said cuts.

9. A tote box with a self-locking top rail comprising:

a box formed from a foldable box blank, said box having a bottom, two opposed side walls and two opposed end walls, said side walls and end walls having upper edges defining a top edge of the box, four corner enhancers, each corner enhancer joining one of said end walls to one of said side walls, each corner enhancer having first and second open leg channels each formed between a pair of leg channel walls, each of said open leg channels having a width defined between planar inside surfaces of said leg channel walls, one of said end walls being located inside one of said first and second open leg channels and one of said side walls being located inside the other of said first and second open leg channels, and a top rail extending around the top edge of said box, said top rail comprising a pair of side pieces, a pair of end pieces and four corner pieces, each of said side and end pieces of said top rail having a downwardly open channel formed between a pair of channel side walls, said downwardly open channel being fitted over said upper edges of said walls, each of said side pieces and each of said end pieces having holes extending through said downwardly open channel at opposite ends of said piece, each of said corner pieces having a pair of projections, one of said projections engaging one of holes of one of said corner pieces and the other of said projections engaging one of said holes of one of said end pieces, thereby joining one of said end pieces and one of said side pieces.

10. The tote box of claim 9 wherein at least two of said walls have tabs.

11. The tote box of claim 10 wherein at least one of said channel side walls has an inwardly extending hook for engaging said tabs and locking said top rail over said top edge of said box.

12. The tote box of claim 9 wherein said foldable box blank is made of corrugated plastic sheet.

13. The tote box of claim 9 wherein said corner enhancers and said side and end pieces of said top rail are extruded.

14. The tote box of claim 9 wherein said pieces of said top rail have a vertical lip on an outside upper edge thereof for facilitating stacking of a second tote box on top of said tote box.

15. The tote box of claim 9 wherein each of said opposed side walls have an identical first length and each of said opposed end walls have an identical second length, said first length being greater than said second length.

16. A tote box with a self-locking top rail comprising:

a box formed from a foldable box blank of a uniform thickness, said box having a bottom, two opposed side walls and two opposed end walls, said side walls and end walls having upper edges defining a top edge of the box, and a top rail extending around the top edge of said box, said top rail comprising two side pieces, two end pieces and four corner pieces, each of said side pieces and each of said end pieces of said top rail having a downwardly open channel defined by a top and a pair of channel side walls extending downwardly from said top, said top of said downwardly open channel having holes formed therein, each of said corner pieces of said top rail having projections for engaging said holes of said side pieces and said end pieces of said top rail in order to lock said pieces of said top rail together.

17. The tote box of claim 16 wherein at least two of said walls of said box each have at least one tab for engaging said top rail.

18. A method of assembling a tote box with a self-locking top rail comprising four corner pieces, two end pieces and two side pieces, each of said corner pieces of said top rail having outer portions with projections, each of said side pieces and each of said end pieces of said top rail having a downwardly open channel defined by a top and two channel side walls, said top of said downwardly open channel having holes therethrough, said method comprising:

folding a box blank into a box, said box having a bottom, two opposed side walls and two opposed end walls, said side walls and end walls having upper edges defining a top edge of the box, at least two opposed walls each having at least one tab, locating portions of said side and end walls of said box inside first and second open leg channels of corner enhancers, each of said open leg channels being formed between a pair of leg channel walls, and securing said corner pieces of said top rail over upper portions of said corner enhancers, securing said side and end pieces of said top rail to said corner pieces of said top rail by passing said projections through said holes of said side and end pieces of said top rail, said downwardly open channels of said side and end pieces of said top rail being placed over upper edges of said walls of said box.

19. The method of claim 18 further comprising locking said pieces of said top rail over said upper edges of said box walls by engaging said tabs with hooks extending inwardly from channel side walls of said side and end pieces of said top rail.

* * * * *

UNITED STATES PATENT AND TRADEMARK OFFICE

CERTIFICATE OF CORRECTION

PATENT NO. : 6,547,127 B2 
DATED : April 15, 2003
INVENTOR(S) : Judson A. Bradford and Timothy A. Bublitz It is certified that error appears in the above-identified patent and that said Letters Patent is hereby corrected as shown below:

Column 1,
Line 18, replace "is both fully" with -- is fully --.
Line 45, the paragraph beginning with "Therefore, it is also recommended" should be part of the preceding paragraph.

Column 5,
Line 22, replace "walls 26*a,b* have" with -- walls 26*a,b* has --.
Line 32, replace "but be" with -- but may be --.

Column 6,
Line 7, replace "width" with -- widths --.

Column 8,
Line 52, the paragraph beginning with "The weight of the tote" should be part of the preceding paragraph.

Column 12,
Line 25, replace "of holes" with -- of said holes --.
Line 45, replace "side walls have" with -- side walls has --.

Signed and Sealed this

Twenty-ninth Day of July, 2003

JAMES E. ROGAN
*Director of the United States Patent and Trademark Office*